US009574446B2

(12) United States Patent
Contaldi

(10) Patent No.: US 9,574,446 B2
(45) Date of Patent: Feb. 21, 2017

(54) EXPANDER FOR RECOVERY OF THERMAL ENERGY FROM A FLUID

(75) Inventor: Giulio Contaldi, Segrate (IT)

(73) Assignee: ING ENEA MATTEI S.p.A. (IT)

( * ) Notice: Subject to any disclaimer, the term of this patent is extended or adjusted under 35 U.S.C. 154(b) by 223 days.

(21) Appl. No.: 14/345,639

(22) PCT Filed: Sep. 19, 2011

(86) PCT No.: PCT/IT2011/000324

§ 371 (c)(1),
(2), (4) Date: May 6, 2014

(87) PCT Pub. No.: WO2013/042141

PCT Pub. Date: Mar. 28, 2013

(65) Prior Publication Data

US 2014/0369877 A1 Dec. 18, 2014

(51) Int. Cl.

| | |
|---|---|
| ***F01C 1/344*** | (2006.01) |
| ***F01C 11/00*** | (2006.01) |
| ***F01C 21/06*** | (2006.01) |
| ***F04C 23/02*** | (2006.01) |

(52) U.S. Cl.

CPC ..... *F01C 1/344* (2013.01); *F01C 1/3442* (2013.01); *F01C 11/00* (2013.01); *F01C 11/004* (2013.01); *F01C 11/008* (2013.01); *F01C 21/06* (2013.01); *F04C 23/02* (2013.01)

(58) Field of Classification Search

CPC ..... F01C 1/344; F01C 11/00; F01C 11/004; F01C 11/008; F01C 21/06; F01C 1/3442; F04C 23/02

USPC ..... 60/651, 671; 418/102, 187–188, 263, 418/267, 268

See application file for complete search history.

(56) References Cited

U.S. PATENT DOCUMENTS

| | | | | |
|---|---|---|---|---|
| 3,585,973 | A * | 6/1971 | Klover | F01C 1/32 123/243 |
| 7,040,278 | B2 * | 5/2006 | Badgley | F01C 11/004 123/204 |
| 7,971,424 | B2 * | 7/2011 | Masada | F01K 9/003 60/39.182 |
| 2005/0262858 | A1 | 12/2005 | Inaba et al. | |

(Continued)

FOREIGN PATENT DOCUMENTS

| | | |
|---|---|---|
| DE | 1963369 | 6/1971 |
| DE | 4010206 | 10/1991 |

(Continued)

OTHER PUBLICATIONS

Corresponding International Search Report and Written Opinion dated Dec. 7, 2012.

*Primary Examiner* — Hoang Nguyen
(74) *Attorney, Agent, or Firm* — The Belles Group, P.C.

(57) ABSTRACT

A bladed expander for recovery of thermal energy from a working fluid, comprising a stator provided with an inlet port and an outlet port for the working fluid, a rotor housed within the stator, and a plurality of blades set between the rotor and the stator so as to delimit between them a plurality of compartments with variable volume that increases between the inlet port and the outlet port. The stator and the rotor are subjected to a heat exchange with a hot fluid so as to carry out a transformation of expansion during which the working fluid receives thermal energy from outside.

24 Claims, 8 Drawing Sheets

(56) References Cited

U.S. PATENT DOCUMENTS

2009/0320477 A1* 12/2009 Juchymenko ..... F01K 23/065
60/651

FOREIGN PATENT DOCUMENTS

| | | |
|---|---|---|
| DE | 202005008514 | 9/2005 |
| EP | 2093374 | 8/2009 |
| FR | 2944832 | 10/2010 |

* cited by examiner

EXPANDER FOR RECOVERY OF THERMAL ENERGY FROM A FLUID

CROSS-REFERENCE TO RELATED PATENT APPLICATIONS

The present application is a U.S. national stage application under 35 U.S.C. §371 of PCT Application No. PCT/IT2011/00324, filed Sep. 19, 2011, the entirety of which is incorporated herein by reference.

TECHNICAL FIELD

The present invention relates to a bladed expander for recovery of thermal energy from a hot working fluid and conversion of said energy into mechanical energy.

BACKGROUND ART

As is known, in some types of machines (for example, internal-combustion engines for vehicle applications or for the generation of mechanical or electrical energy), of industrial plants and systems for the production of energy (for example, geothermal systems defined as "low-enthalpy systems" or for exploitation of the thermal energy produced by biomasses, which still present thermal flows that usually constitute waste but are potentially useful) the problem of recovering the thermal energy of a hot fluid at a relatively low temperature and of converting it into mechanical energy is posed.

For this purpose, it is known to use a Rankine cycle or Hirn cycle in which a working fluid in the liquid state is pressurized, heated via a heat exchange with the fluid from which the thermal energy is to be recovered up to total or partial vaporization, superheated or not, and then expanded in an expander that produces mechanical power available at its own output shaft (which can be exploited directly or converted into electrical energy via a generator driven by said shaft).

Given the low temperatures, the working fluid is generally constituted by an organic fluid, such as for example a chlorofluorocarbon in pure form or in mixture or a fluorocarbon, etc., in which case the cycle is usually referred to as ORC (Organic Rankine Cycle).

As expander, it is known to use a dynamic bladed expander or a volumetric expander, in this latter case, of the bladed type or some other type.

If the thermal power recovered from the working fluid is of limited intensity and temperature, there exist known technological and constructional difficulties regarding:

a) the production of a high-efficiency dynamic expander (turbine): the low flow rates of working fluid and the low enthalpies would lead to a general layout of the turbine (areas of passage, heights of blading, etc.) that prevents high (adiabatic, isoentropic) efficiency;

b) the contact between the hot working fluid and the surfaces of the machine causes a cooling of the working fluid and its condensation on the surfaces themselves, with loss of efficiency of conversion;

c) in the case of bladed volumetric expanders, the difficulties referred to in point a) cease to exist, even though the difficulties referred to in point b) remain, albeit to not such an important degree;

d) the frictions due to contact between the stator blades and the rotor blades, which are intensified in the presence of fluid vapours that expand, are the cause of a reduction of the efficiency of the machine; there derives therefrom the need for a technological improvement of the expanders with respect to the current state of the art.

DISCLOSURE OF INVENTION

The aim of the present invention is to provide a bladed expander with improved efficiency for the aforesaid application.

The aforesaid aim is achieved by a bladed expander according to claim 1.

The present invention likewise regards a system for recovery of the thermal energy from a hot fluid, which uses an expander.

According to a first embodiment, the system can be integrated to the machine that produces the hot fluid from which the energy is recovered, and the mechanical power recovered can be used directly in the machine itself. For example, the machine can be constituted by a compressor, in which case the hot fluid can be constituted by the lubricating/cooling oil of the compressor. Alternatively, the machine can be constituted by an internal-combustion engine, for example an engine for vehicle applications or a generator set, and the hot fluid can be constituted by the exhaust gases of the motor itself, by the lubricating and cooling fluids of the motor, or by the cooling fluid of the supercharged air.

According to another embodiment, the system is an autonomous unit interfaceable with an external machine or system.

BRIEF DESCRIPTION OF THE DRAWINGS

For a better understanding of the present invention, some preferred embodiments are described in what follows, with reference to the attached drawings, wherein.

BEST MODE FOR CARRYING OUT THE INVENTION

Figure 1:
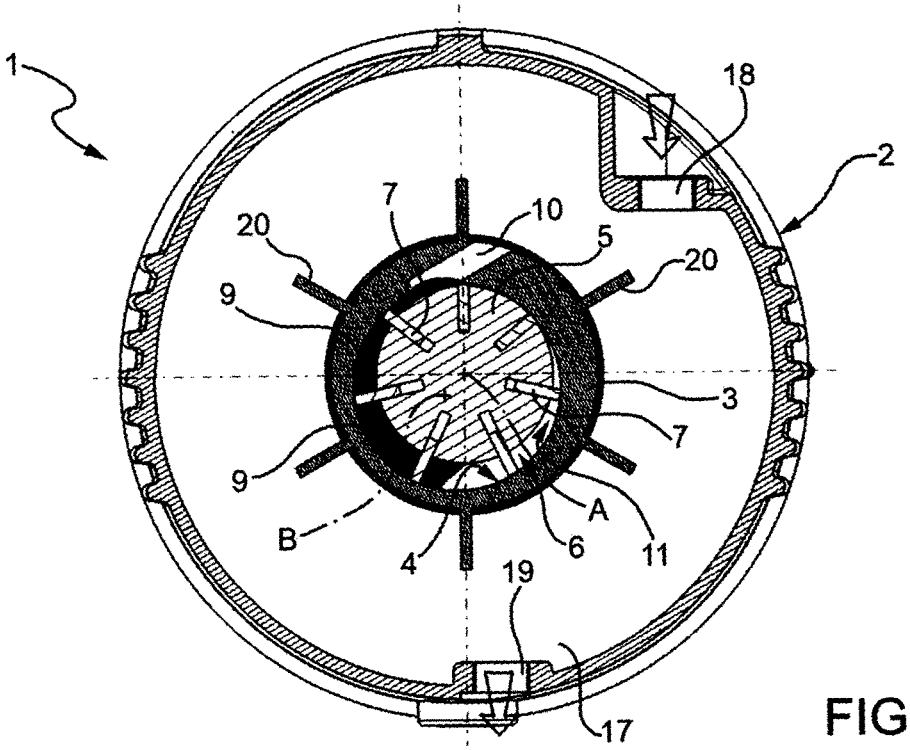
FIG. 1 is a cross-sectional view of a bladed expander according to the present invention.
Figure 2:
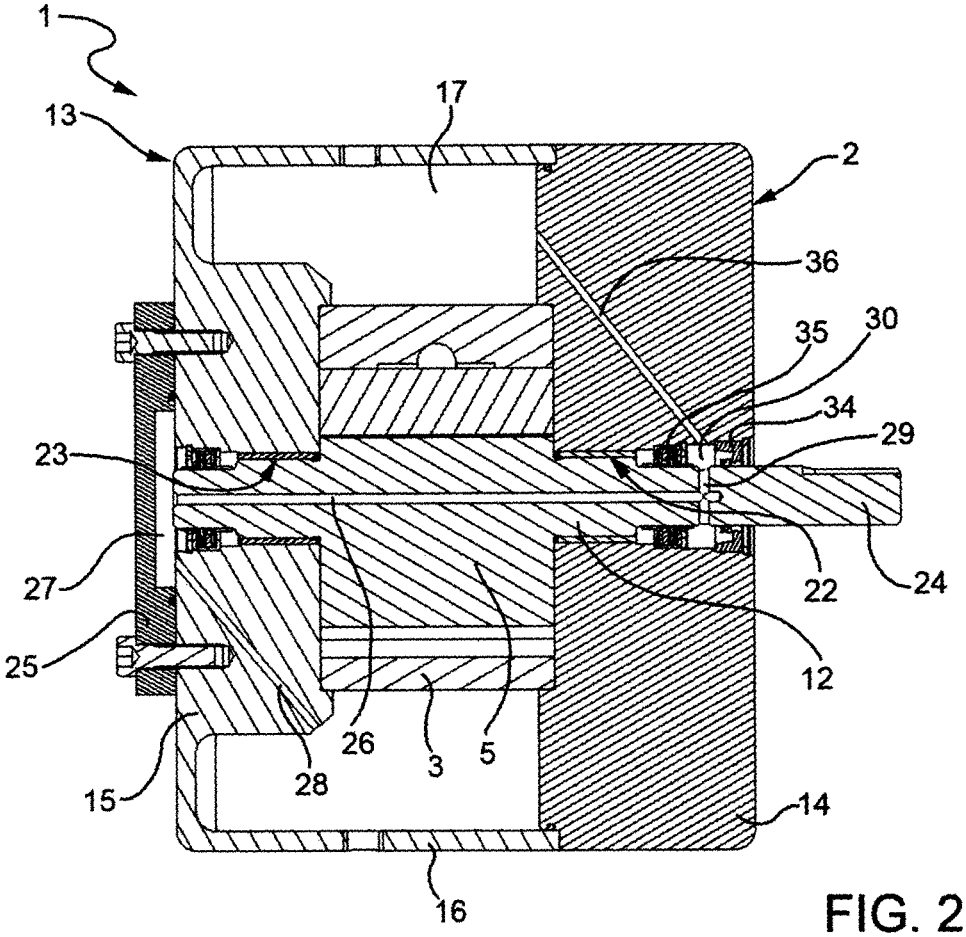
FIG. 2 is a schematic axial sectional view of the expander of FIG. 1.

With reference to FIGS. 1 and 2, designated as a whole by 1 is a bladed expander according to the present invention.

The expander 1 basically comprises an external casing 2, an annular stator 3 with axis A housed in the casing 2 and provided with a cylindrical cavity 4 with axis B, which is parallel to and distinct from the axis A, and a substantially cylindrical rotor 5 with axis A, housed in the cavity 4.

As a result of the eccentricity of the cavity 4 with respect to the rotor 5, formed between the rotor 5 and the stator 3 is an annular chamber 6 of variable width in a radial direction.

The rotor 5 carries a plurality of blades 7 extending in a radial direction in the annular chamber 6 and radially slidable so as to co-operate substantially in a sealed way with an inner surface 8 of the stator 3. The blades 7 are spaced at equal distances apart circumferentially around the rotor 5 and divide the annular chamber 6 into a plurality of compartments 9 with variable volume.

The stator 3 has an inlet port 10 in the area of minimum radial width of the compartment 6 and an outlet port 11 in the area of maximum radial width of the compartment 6 in such a way that each chamber 9 increases progressively in volume from the inlet port 10 to the outlet port 11.

The casing 2 is conveniently made up in two pieces 13, 14, of which one (13) is a cup-shaped body defining integrally a head 15 and an outer annular wall 16, and the other (14) constitutes the other head of the casing.

The casing 2 defines an annular chamber 17 surrounding the stator 3, which has an inlet 18 and an outlet 19 for connection to an external hydraulic circuit, as will be described more fully in what follows. The annular chamber 17 is delimited axially by the heads 14, 15 and radially by the stator 3 on the inside and by the wall 16 on the outside.

Conveniently, the stator 3 is provided with radial fins 20 extending within the annular chamber 17 (FIG. 1), which have the purpose of increasing the surface of heat exchange with the fluid contained therein.

The expander 1 is provided with an output shaft 12, which in the example illustrated is integral with the rotor 5. The output shaft 12 is supported in respective through seats 22, 23 of the heads 14, 15, and exits radially from the head 14 with an axial end 24 of its own, which constitutes a power take off designed to be connected to a current generator or a motor functioning as generator or other mechanical load, as will be described more fully in what follows.

The seat 23 of the head 15 is closed axially by a lid 25.

The shaft 12 is conveniently provided with a blind axial hole 26, which extends substantially throughout its length except for the end 24. The hole 26 gives out axially into a chamber 27 made in the lid 25 and communicating with a first area of the annular chamber 17 through a channel 28 made in the head 15. An opposite end of the hole 26 is connected by radial holes 29 to a portion 30 of the seat 22 and is delimited axially in a sealed way by a pair of gaskets 34, 35. The hole 26 could present devices (not represented) designed to increase the coefficient of heat exchange. The portion 30 communicates with a second area of the annular chamber 17 opposite to the first area via a channel 36 made in the head 14.

In use, the expander 1 is used for carrying out the step of expansion of a thermodynamic cycle of an ORC (Organic Rankine Cycle) type or Hirn type, during which it is possible to recover mechanical energy at the shaft 12 by subtracting thermal energy from a working fluid, generally an organic fluid or mixture, such as a chlorofluorocarbon in pure form or in mixture or a fluorocarbon, or the like.

The inlet port 10 and outlet port 11 of the expander are consequently connected, respectively, to a high-pressure branch and to a low-pressure branch of a closed circuit traversed by the working fluid.

The annular chamber 17, the hole 26 of the shaft 12, and the corresponding connection channels and ports define as a whole a heating line 37 designed to be connected to a fluid source at a temperature at least equal to the inlet temperature of the working fluid. In this way, the expansion is carried out in conditions such as to be able to receive thermal energy from outside, instead of being substantially adiabatic, as occurs in expanders of a conventional type.

The ideal configuration would be to carry out an isothermal expansion or even an expansion at an increasing temperature if the fluid that laps the chamber 17 were so to allow.

The calculation of the work of expansion of a gas that expands following upon a variation of the volume that contains it can be performed by the equation of conservation of energy written for closed systems. For ideal processes (absence of losses), the work can be expressed as $$L=\int_{Vin}^{Vfin} p\,dV \tag{1}$$

where:

Vin is the initial volume of the compartment; and

Vfin is the final volume of the compartment.

Since Vfin>Vin, the work of expansion is positive and hence exchanged with the outside world (from the fluid that expands to the mobile members of the machine).

The integral (1) can be calculated once the evolution of the pressure during the variation of volume (thermodynamic transformation) is known. In other words, Eq. (1) becomes $$L=\int_{Vin}^{Vfin} p(V)\,dV \tag{2}$$

The work exchanged thus depends upon the thermodynamic transformation that the gas undergoes during the transformation of expansion inside the compartments.

Figure 3:
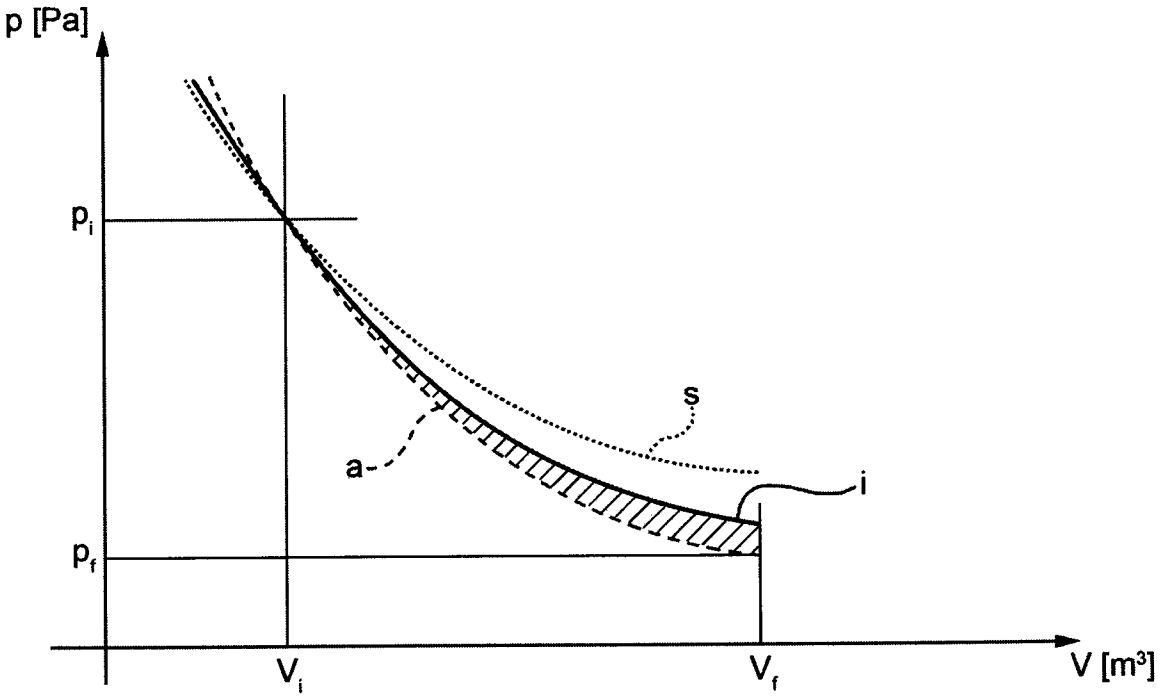
FIG. 3 is a graph illustrating the thermodynamic advantages of the present invention.

Represented in FIG. 3 are the cases of an adiabatic transformation (curve a) and of an isothermal transformation (curve i).

The equation of the transformation will be $$p(V)=p_{in}V_{in}^{k}V^{-1} \tag{3}$$

in the case of the adiabatic transformation and $$p(V)=p_{in}V_{in}V^{-1} \tag{4}$$

in the case of the isothermal transformation.

In the case of thermostatting of the expansion volume such as to approximate an isothermal transformation, the increase of the work of expansion that derives therefrom is represented by the hatched area in FIG. 3. If the transformation of expansion were at an increasing temperature (by virtue of the heat exchange that takes place between the fluid in the chamber 17 and the working fluid in the compartments), a trace thereof in the plane pV would be the curve S of FIG. 3, and the benefit of said invention would be still greater.

The advantage of the stator and rotor heating proves even greater in the case where the fluid that expands in the compartment can present a transition of state from vapour to liquid: this is the case of water vapour or of any other substance, either pure or in mixture.

During expansion the pressure decreases within the compartment and along with it the temperature. If the pressure during expansion reaches the value of the saturation pressure (at the temperature of the fluid), part of the vapour (which is by now saturated and dry) starts to condense so that a given fraction becomes liquid.

Obviously, if the fluid during expansion receives thermal energy from outside (from the annular chamber 17), the condensation of the fluid is delayed if not prevented altogether.

The fraction of fluid that condenses represents a loss of work of expansion in so far as the liquid no longer undergoes variations of volume during the process of expansion.

Thermostatting of the expander 1 consequently produces a dual advantage:

a) it causes the work of expansion to increase if the working fluid is a gas or a vapour when it is in the aeriform state;

b) it prevents condensation of the working fluid in contact with the surfaces of the machine if the working fluid is a vapour, thus eliminating the consequent loss of work; in fact, in the case where the working fluid is a vapour of pure substance or of mixtures, keeping the rotor and the stator at a level of temperature that is as high as possible produces the further benefit of preventing local condensation of the vapour, with generation of a film of liquid in contact with the inner surfaces of the expander and consequent loss of power.

Figure 4:
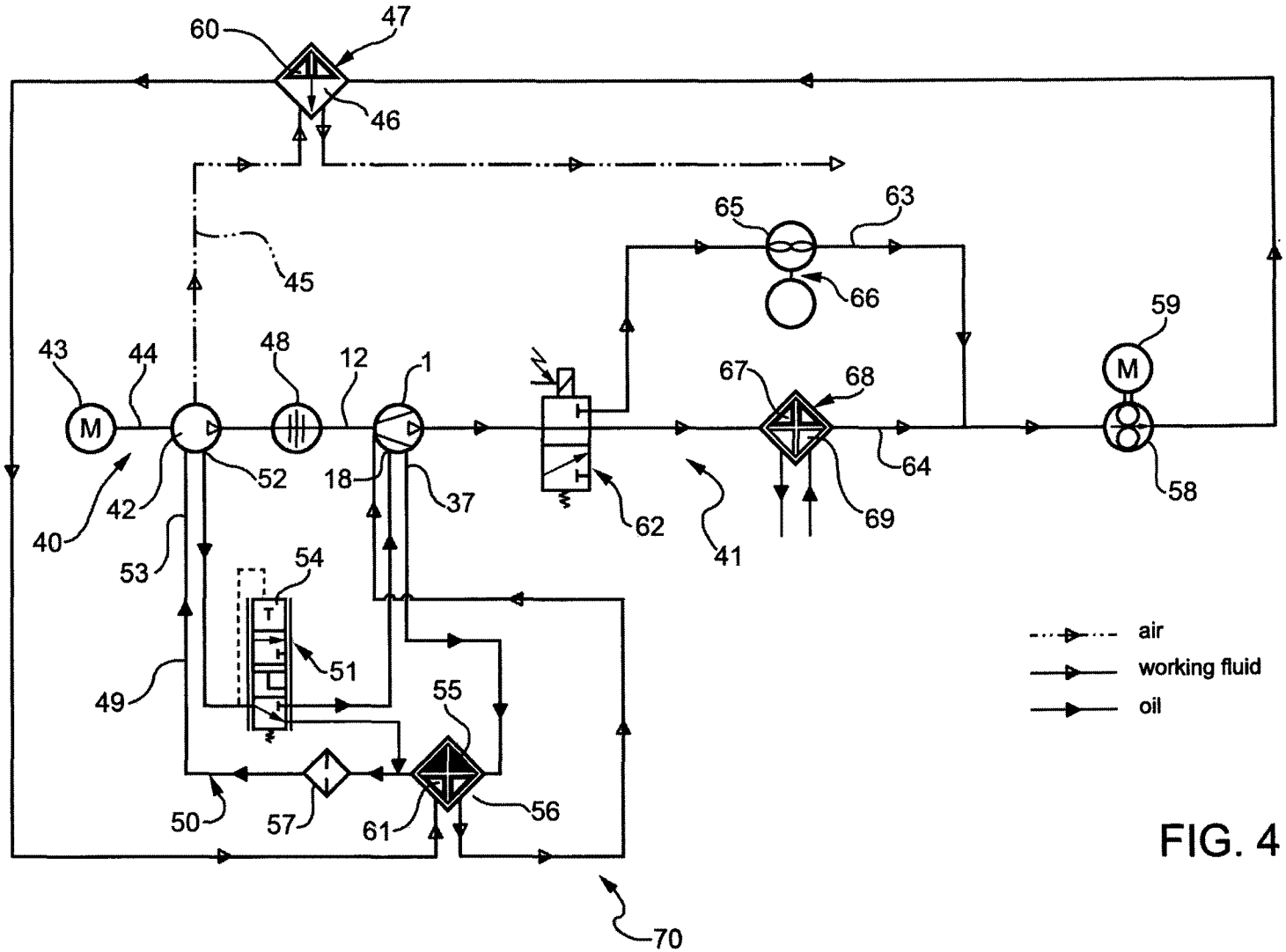
FIG. 4 is a circuit diagram of an integrated compression and recovery unit, which uses the bladed expander of FIG. 1.

FIG. 4 is a diagram of a compression unit 40 comprising a compressor 42 and a recuperator 41 for recovery of the thermal energy from the lubricating/cooling oil of a compressor.

The compression unit 40 basically comprises a compressor 42, for example a bladed volumetric compressor, driven by an electric motor 43 via a shaft 44. Connected in series on the output line of the compressed air 45 of the compressor 42 is a stage 46 of an air/working-fluid heat exchanger 47 or economizer, described more fully in what follows.

Connected via an electromagnetic clutch 48 or other coupling device to the shaft 44 of the compressor 42 is the output shaft 12 of a bladed expander 1 of the type previously described, forming part of the recuperator 41.

The compressor 42 comprises a lubricating/cooling line 49, which is connected to the heating line 37 of the expander 1 to form therewith a closed oil circuit 50. The oil circuit further comprises a three-way by-pass valve 51, with three open-centre positions and continuous positioning, via which an outlet 52 of the oil of the compressor can be connected to the inlet 18 of the expander 1 or else to a line 53 of return to the compressor 42, thus bypassing the expander. The valve 51 is normally in bypass position and is driven into the position of connection to the expander 1 by a thermal actuator 54 controlled by the temperature of the oil at output from the compressor 40. In this way, the recuperator 41 is active only when the compressor reaches the steady-state temperature. The electromagnetic clutch 48 is controlled accordingly; i.e., it is closed until the steady-state temperature is reached.

Connected in series on the line 53 of return to the compressor are a stage 55 of an oil/working-fluid heat exchanger 56, described more fully in what follows and, downstream of this, a filter 57.

The recuperator 41 comprises a closed circuit traversed by the working fluid and operating according to a Rankine cycle (if the organic fluid is brought into saturation conditions) or, preferably, a Hirn cycle (if the organic fluid is brought into superheating conditions).

More in particular, the recuperator 41 comprises a pump 58 driven by an electric motor 59 or other device and designed to bring the working fluid to a pre-set pressure level. At the end of the compression stage, the fluid is in the liquid state.

Downstream of the pump 58, set in series to one another are the other stage 60 of the heat exchanger (economizer) 47, in which the fluid is pre-heated by the heat exchange with the compressed air generated by the compressor 42, and the other stage 61 of the heat exchanger 56, in which the working fluid is further heated and undergoes a change of state (vaporization). Preferably, at output from the heat exchanger 56 the working fluid is in the state of saturated or superheated vapour, as mentioned previously.

Downstream of the heat exchanger 56, the working fluid reaches the expander 1 and, then, a two-position three-way solenoid valve 62, which can deliver the flow selectively, and two circuit branches 63, 64, set in parallel to one another and both connected to the inlet of the pump 58. Set on the first branch 63 is a radiator 65 in heat exchange with a forced air flow generated by an electric fan 66. Set on the second branch 64 is a stage 67 of a heat exchanger 68, the other stage 69 of which is designed to be connected to a source of cold fluid, for example water, which may be available. In the case where it is not necessary to have available this alternative, the solenoid valve 62 can be omitted, and just one between the radiator 65 and the heat exchanger 68 can be used.

The radiator 65 or the heat exchanger 68 constitutes a condenser in which the working fluid undergoes a change of state and returns into the liquid state, subsequently reaching the pump 58 (start of cycle).

Figure 5:
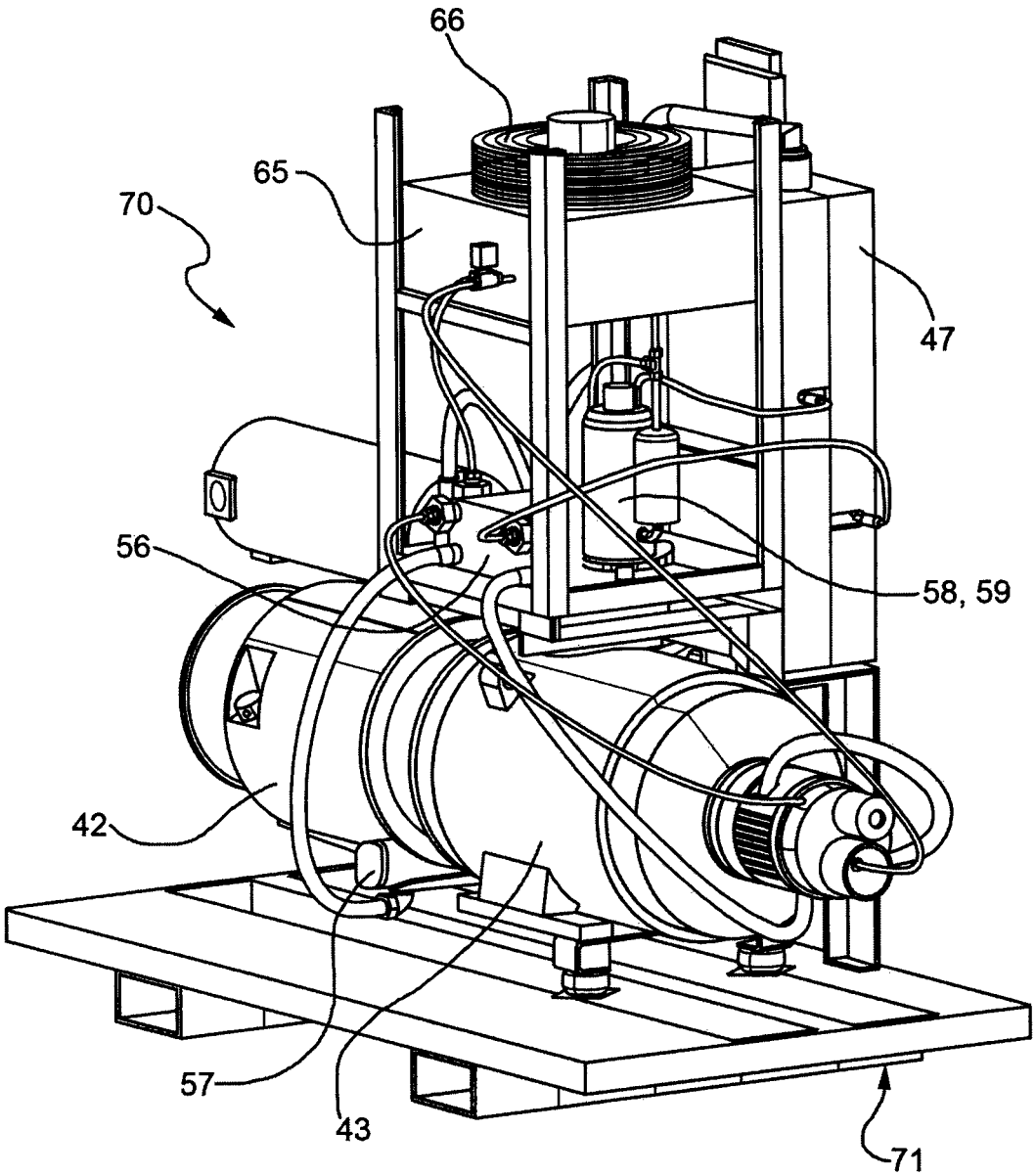
FIGS. 5 and 6 are perspective views from opposite sides of the integrated unit of the diagram of FIG. 4.
Figure 6:
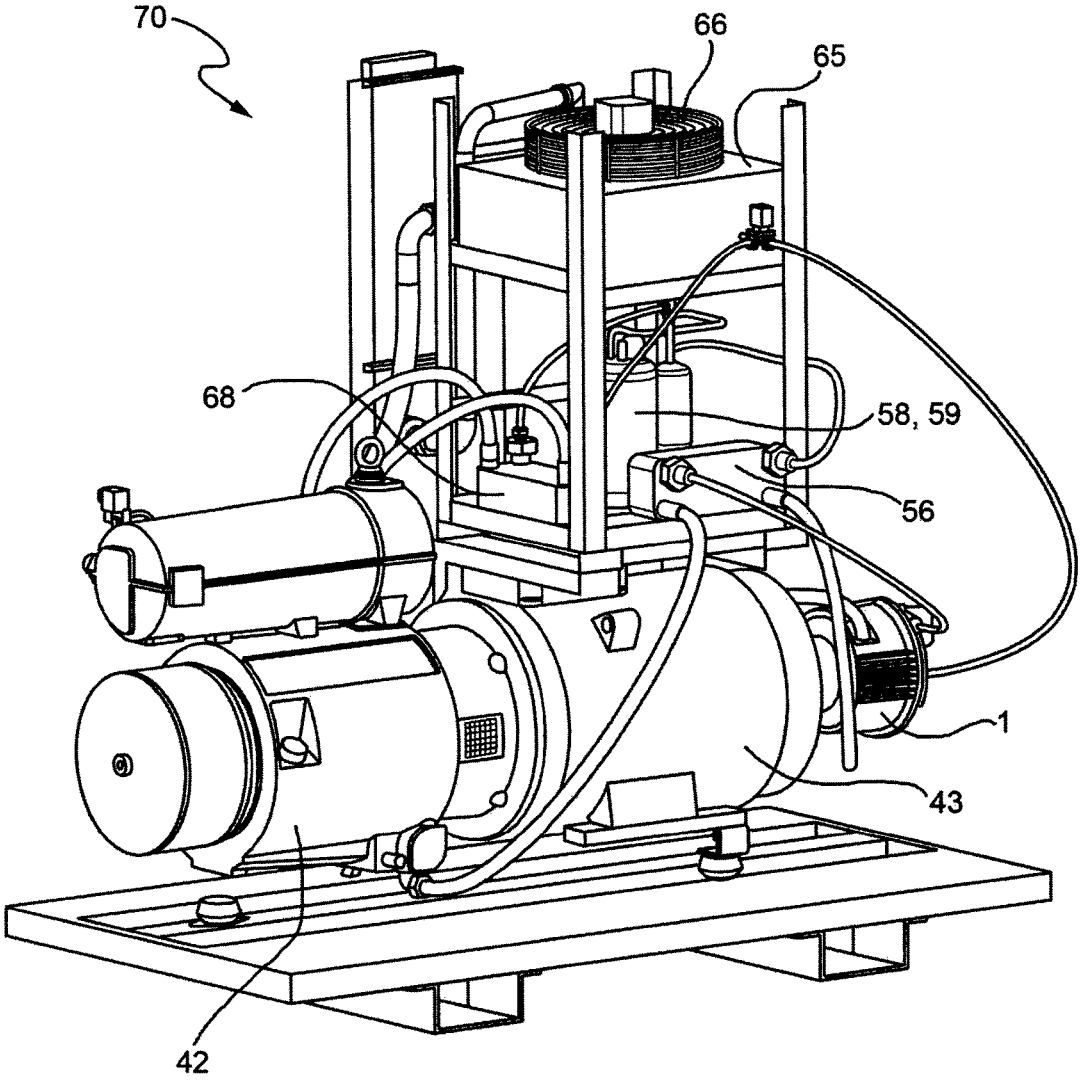

The compression unit 40 and the recuperator 41, in this embodiment, are integrated together to form an integrated compression and energy-recovery unit 70, assembled on a single load-bearing structure 71 (FIG. 5). In FIGS. 5 and 6, which are perspective views of the unit 70, the main components are clearly visible: the compressor 42, the electric motor 43, the expander 1 (all of which on a common axis), the heat exchangers 47 (air/ORC fluid), 56 (oil/ORC fluid), 68 (ORC fluid/water), the radiator 65 with the corresponding electric fan 66, and the oil filter 57.

Figure 7:
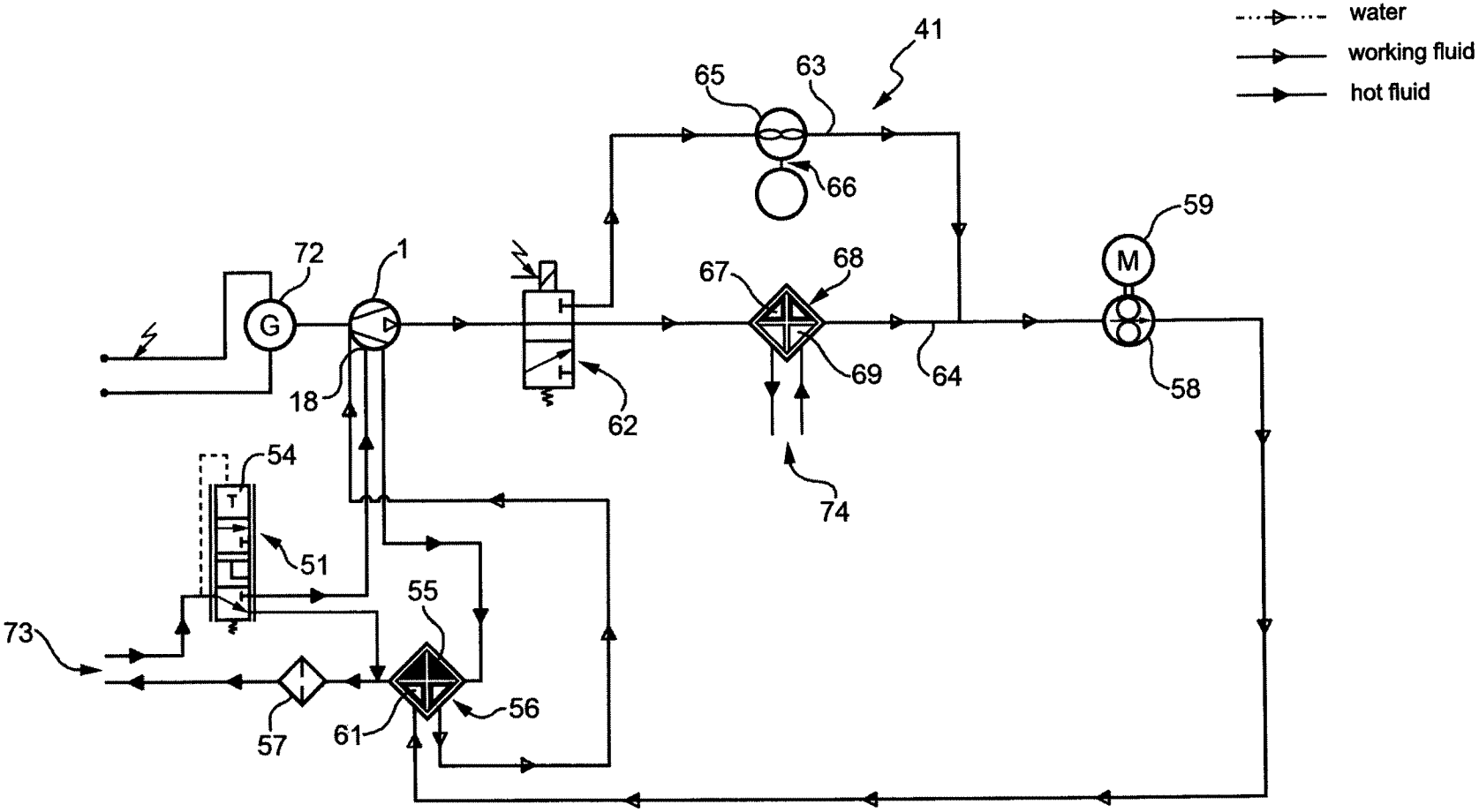
FIG. 7 is a circuit diagram of a thermal-energy recuperator interfaceable with an external compressor.
Figure 8:
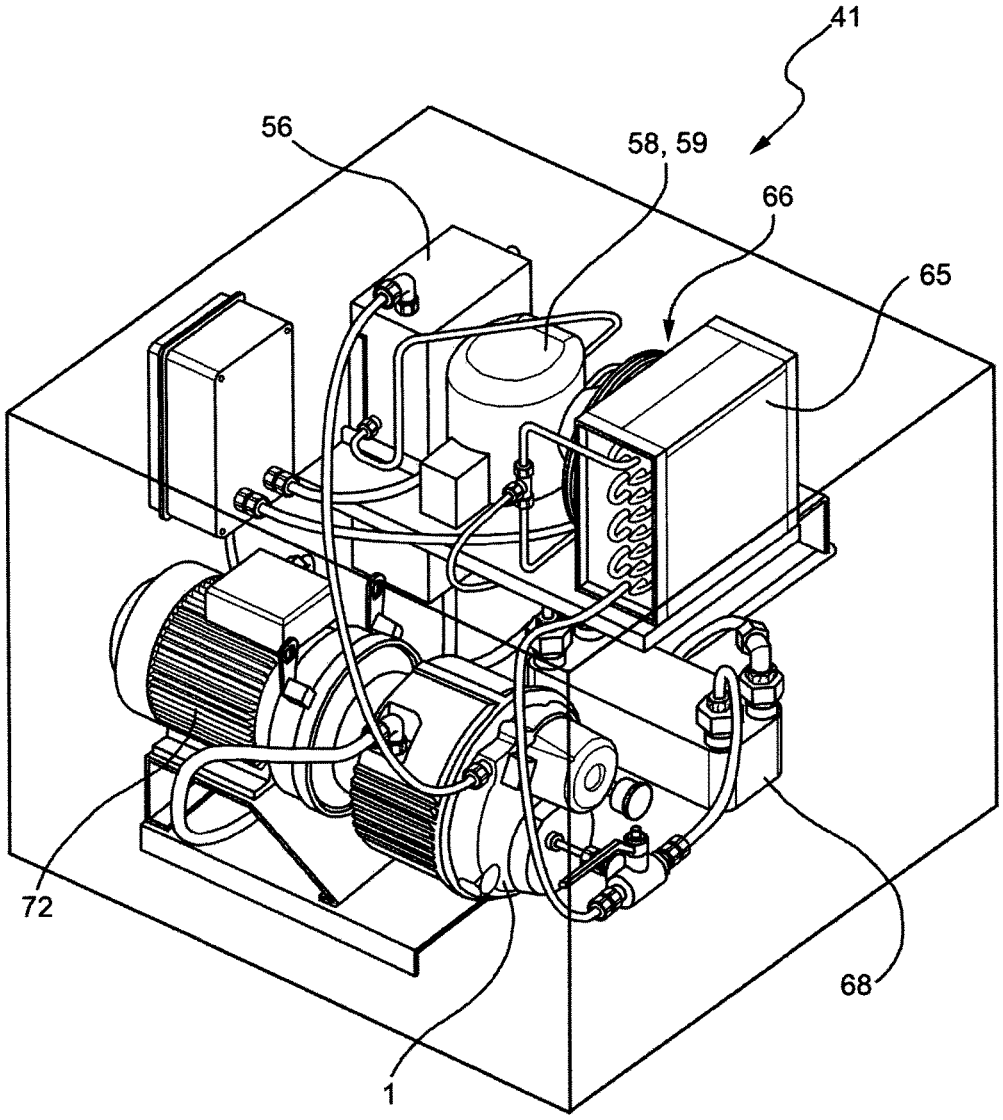
FIG. 8 is a perspective view of the recuperator of the diagram of FIG. 7.

FIGS. 7 and 8 illustrate, instead, an embodiment of the present invention in which the recuperator 41 constitutes an autonomous unit, interfaceable with an external compressor of any type or with another machine or system generating a recoverable thermal power (for example, a static internal-combustion engine or an internal-combustion engine for vehicle applications, or else a system for exploiting geothermal energy or energy produced by biomasses).

The circuit diagram of the recuperator 41 is similar to the one described with reference to the integrated unit. In this case, however, the recuperator comprises an electric generator 72 driven by the bladed expander. Consequently, the energy recovery occurs through the generation of electrical energy, instead of mechanical energy. The economizer 47 can be omitted.

The recuperator 41 has a pair of connections 73 for inlet/outlet of a hot fluid (oil, water, burnt gases, etc.) and a pair of connections 74 for inlet/outlet of a cold fluid (typically water of the water mains), whenever available.

FIG. 8 illustrates an embodiment of the recuperator 41. The components described with reference to the integrated solution of FIGS. 4 and 5 are designated by the same reference numbers, and clearly visible is the electric generator 72 coupled to the bladed expander 1.

In the case where the recuperator 41 is used in combination with an external compressor of conventional type, two situations may basically arise.

Figure 9:
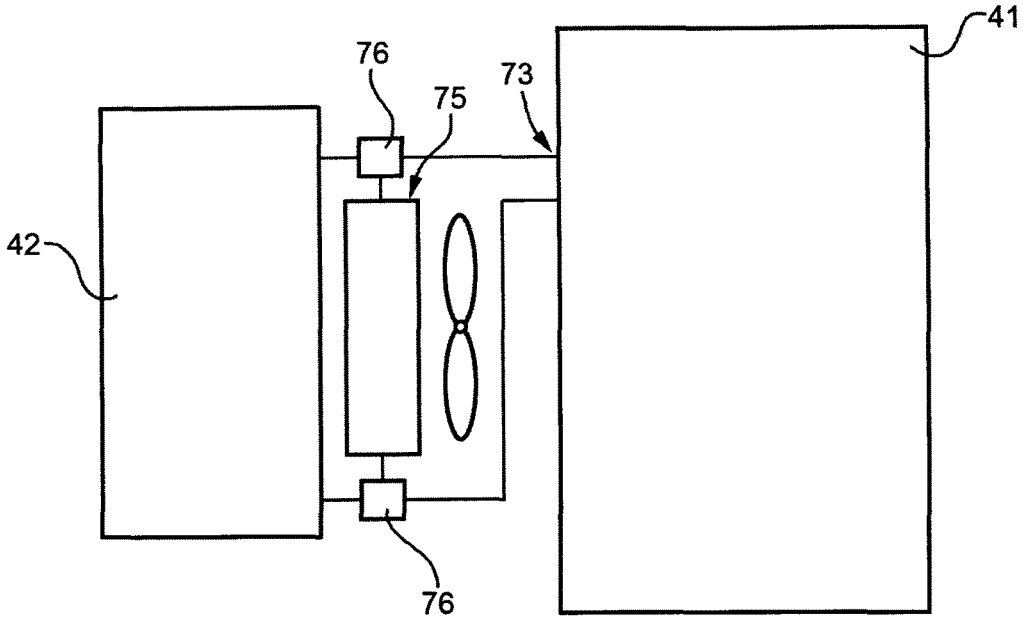
FIGS. 9 and 10 are schematic illustrations of two different possibilities of use of the recuperator of FIG. 8.

If the compressor 42 is provided with a radiator 75 for cooling the oil with forced ventilation (FIG. 9), the hot fluid can be constituted directly by the lubricating/cooling oil of the compressor. In this case, it is sufficient to connect the connections 73 of the recuperator 41 to a pair of bypass valves 76 set upstream and downstream of the radiator 75. The recuperator is consequently set in parallel with respect to the radiator 75, which can be excluded via the bypass valves 76 (and possibly used as emergency solution to prevent machine downtime of the compressor 42 in the case of breakdown or maintenance of the recuperator).

Figure 10:
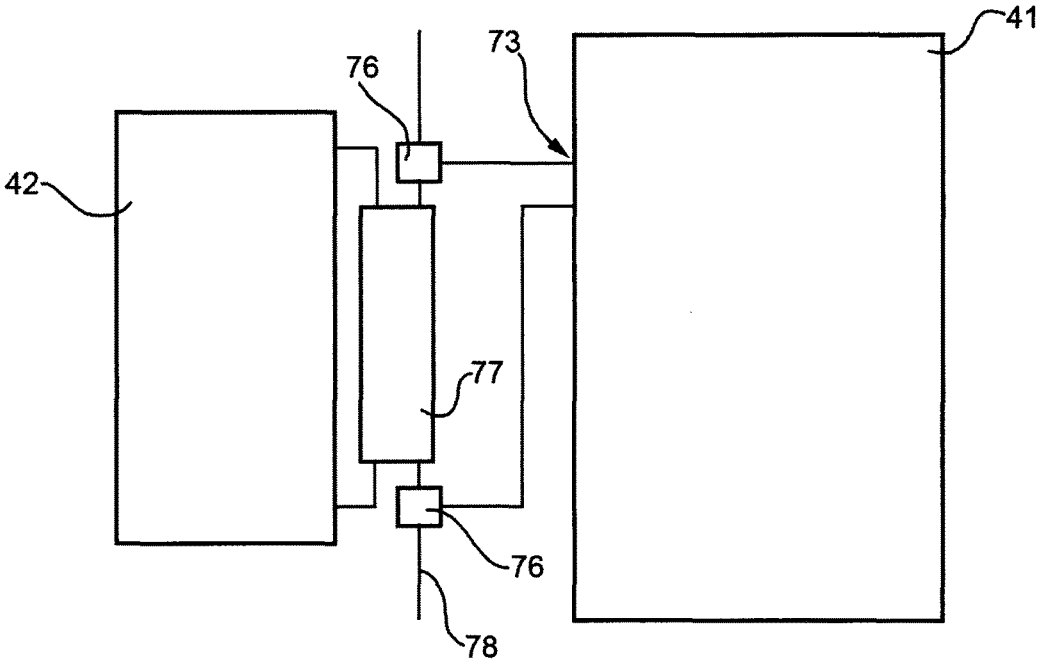

If, instead, the compressor 42 is provided with cooling of the oil with water via a water/oil heat exchanger 77 (FIG. 10), the hot fluid used by the recuperator 41 can be constituted by the cooling water.

In a way similar to what has been described for the previous case, the recuperator 41 is connected in parallel to the water stage of the water/oil heat exchanger 77 via bypass valves 76 set upstream and downstream of the heat exchanger itself along a water line 78.

By switching the bypass valves 76 it is possible to select whether to use the recuperator 41 for the production of electrical energy or else use the cooling water for other purposes (for example, for heating environments in winter).

From an examination of the characteristics of the expander 1 provided according to the invention the advantages that it affords are evident.

As has been set forth in greater detail above, heating of the expander considerably improves the thermodynamic efficiency thereof. In the case where the expander is used in combination with a compressor, thermal power can be recovered from the lubricating/cooling oil of the compressor, and the oil itself can be used also as hot fluid for heating.

The expander can conveniently be used within a recuperator integrated with the compressor or devised as autonomous unit interfaceable with a pre-existing compressor, or also with another machine or system operating with a fluid from which thermal energy can be recovered.

Finally, it is clear that modifications and variations may be made to the expander 1, the recuperator 41, and the integrated unit 70, without thereby departing from the sphere of protection of the claims.

For example, heating of the expander can be limited to the stator or to the rotor, and can be provided in a way different from what has been described.

Heating can be obtained with the fluid from which the thermal energy is recovered or with another fluid, preferably in heat exchange therewith.

The compressor 42 can be of any type.

The fluid used can be an organic fluid such as a chlorofluorocarbon or any other fluid suited to the thermal levels involved.

The invention claimed is:

1. A bladed expander for recovery of thermal energy from a working fluid comprising a stator provided with at least one inlet port and at least one outlet port for the working fluid, a rotor housed within the stator, and a plurality of blades set between the rotor and the stator so as to delimit between them a plurality of compartments with variable volume that increases between the inlet port and the outlet port, said expander including a heating line traversed by a hot fluid and configured so as to subject at least one cavity between the stator and the rotor to a heat exchange with the hot fluid and to carry out on the working fluid a transformation of expansion during which the working fluid receives thermal energy from outside;

the heating line comprising at least one cavity inside the rotor;

a casing housing said stator and provided with a pair of heads and an outer annular wall, an annular chamber being comprised axially between the heads and radially between the stator and the outer annular wall;

said rotor being integrally provided with an output shaft, said at least one cavity inside the rotor comprising an axial hole made in said shaft;

said heating line further comprising a plurality of channels connecting said hole to said annular chamber.

2. The blade expander according to claim 1, wherein the heating line comprises a chamber surrounding the stator at least partially.

3. A recuperator of thermal energy from a fluid, comprising a Rankine-cycle or Him-cycle thermodynamic circuit, which uses an expander according to claim 1.

4. The recuperator according to claim 3, the thermodynamic circuit comprises a pump, an evaporator for heating and vaporizing said working fluid by heat subtracted from a fluid from which thermal energy is recovered, the evaporator being connected to a delivery of the pump and to an inlet of the expander, and a condenser connected to an outlet of the expander and to an inlet of the pump.

5. The recuperator according to claim 4, said hot fluid used in said heating line is the same fluid from which thermal energy is recovered.

6. The recuperator according to claim 5, wherein the recuperator is provided as autonomous unit provided with connections at least for said hot fluid, said bladed expander being connected to a current generator.

7. An integrated compression and energy-recovery unit, comprising a compressor driven by an electric motor and a recuperator according to claim 3, said bladed expander being mechanically connected to said compressor and to said electric motor so as to supply mechanical power to said compressor.

8. The unit according to claim 7, said hot fluid is the lubricating/cooling oil of said compressor.

9. The unit according to claim 8, the fluid from which thermal energy is recovered is the lubricating/cooling oil of said compressor.

10. The unit according to claim 9, further comprising a closed oil circuit comprising a lubricating/cooling line of the compressor, the heating line of the expander, and a stage of the evaporator.

11. The unit according to claim 10, further comprising an economizer in which the working fluid is pre-heated by means of heat exchange with the compressed air produced by the compressor, the economizer being set upstream of the evaporator for condensing the moisture present in the compressed air.

12. The unit according to claim 10, wherein the oil circuit comprises a bypass valve for selectively connecting an oil outlet of the compressor to the expander to a line of return to the compressor itself, and a coupling device for connecting the expander mechanically in a selective way to the compressor.

13. A compression and energy-recovery unit comprising a compressor driven by an electric motor and provided with an lubricating/cooling oil system, and a Rankine-cycle or Him-cycle recuperator having a bladed expander and uses a working fluid in at least indirect heat exchange with the lubricating/cooling oil of the compressor;

wherein said bladed expander is mechanically connectable to said compressor so as to supply mechanical power to the compressor itself; and wherein the bladed expander comprises:

a stator provided with an inlet port and an outlet port for the working fluid, a rotor housed within the stator and a plurality of blades set between the rotor and the stator so as to delimit between them a plurality of compartments with variable volume that increases between the inlet port and the outlet port, and a heating line traversed by a hot fluid and configured so as to subject at least one between the stator and the rotor to a heat exchange with the hot fluid and to carry out on the working fluid a substantially isothermal transformation of expansion.

14. The unit according to claim 13, said bladed expander is connected to an electric generator.

15. The unit according to claim 13, the heating line comprises a chamber at least partially surrounding the stator.

16. The unit according to claim 13, the heating line comprises at least one cavity inside the rotor.

17. The unit according claim 13, said hot fluid is the lubricating/cooling oil of the compressor.

18. The unit according to claim 13, said hot fluid is a fluid in heat exchange with the lubricating/cooling oil of the compressor.

19. The unit according to claim 13, the recuperator comprises a pump, at least one heat exchanger for heating and vaporizing said working fluid using heat subtracted from the lubricating/cooling oil of the compressor, the heat exchanger being connected to a delivery of the pump and to an inlet of the bladed expander, and a condenser connected to an outlet of the expander and to an inlet of the pump.

20. The unit according to claim 19 further comprising a closed oil circuit comprising a lubricating/cooling line of the compressor, the heating line of the evaporator, and a stage of the exchanger for heating and vaporization of the working fluid.

21. The unit according to claim 20 further comprising an economizer, in which the working fluid is pre-heated by means of heat exchange with the compressed air produced by the compressor, the economizer being set upstream of the heat exchanger for heating and vaporization of the working fluid.

22. The unit according to claim 20, wherein the oil circuit comprises a bypass valve for selectively connecting an outlet of the compressor to the expander or to a line of return to the compressor itself.

23. The unit according to claim 13 further comprising an electromagnetic clutch for mechanically selectively connecting the expander to the compressor.

24. The unit according to claim 14, wherein said recuperator is provided as an autonomous unit interfaceable with said compressor and purposely provided with connections for a hot fluid constituted by the lubricating/cooling oil of the compressor or by a fluid in heat exchange therewith.

* * * * *